United States Patent [19]

Scheibel

[11] 4,028,079

[45] June 7, 1977

[54] CASCADE REFRIGERATION SYSTEM

[75] Inventor: Edward G. Scheibel, Media, Pa.

[73] Assignee: Suntech, Inc., St. Davids, Pa.

[22] Filed: Feb. 23, 1976

[21] Appl. No.: 660,218

[52] U.S. Cl. ..... 62/335

[51] Int. Cl.[2] ..... F25B 7/00

[58] Field of Search ..... 62/335

[56] References Cited

UNITED STATES PATENTS

| | | | |
|---|---|---|---|
| 2,453,823 | 11/1948 | Williams | 62/335 |
| 2,456,386 | 12/1948 | Cooper | 62/335 |
| 2,617,272 | 11/1952 | Aicher | 62/335 |
| 2,812,646 | 11/1957 | Twomey | 62/335 |
| 3,067,592 | 12/1962 | McFarlan | 62/335 |

*Primary Examiner*—Lloyd L. King

*Attorney, Agent, or Firm*—Donald R. Johnson; J. Edward Hess; Paul Lipsitz

[57] ABSTRACT

In a cascade refrigeration system where low pressure vapor from an evaporator stage is compressed and then recycled for condensation to the evaporator of a previous stage, the improvement of passing the low pressure vapor from an evaporator stage through a heat exchanger to heat said vapor to ambient temperature, compressing said heated vapor, removing the compressor work by passing said compressed vapor through a cooler, cooling said compressed vapor by passing it through said heat exchanger in heat exchange relationship with said low pressure vapor, condensing it in the evaporator of the next higher temperature cycle of the cascade system and recycling the liquid to the low pressure evaporator stage.

7 Claims, 3 Drawing Figures

CASCADE REFRIGERATION SYSTEM

In the conventional cascade refrigeration cycle the vapor produced in any stage is compressed and condensed in the previous stage at a higher pressure. The high pressure liquid is then returned to the evaporator through a pressure reducing valve where it evaporates to condense the high pressure gas from the next stage. The first stage condenser transfers the heat to cooling water and each successive stage operates at lower temperatures, depending upon the vapor pressure of the different fluids used in the stages. These fluids must be condensed at below their critical temperature and evaporated at close to their atmospheric boiling points. Pressures below atmospheric are sometimes used to bridge the temperature range required between the preceding and following stages, but this reduces the gas density and thus the efficiency of the centrifugal compressor normally used in this operation. Thus, subatmospheric pressures are used only when no known compound has the desired temperature spread between its normal boiling point and its critical pressure. Wherever possible in such cases, the desired temperature spread is obtained by increasing the number of stages. Typical compounds for the first stage are propane, ammonia, sulfur dioxide or the higher boiling chlorofluorocarbon refrigerants. In the second stage, ethane, ethylene or the lower boiling chlorofluorcarbon refrigerants are generally used. The third and fourth stages are usually methane and nitrogen and for producing liquid hydrogen a fifth stage can be added using neon or the nitrogen stage can be operated at sub-stmospheric pressure. Liquid hydrogen evaporation can produce liquid helium which requires temperature within 4° of absolute zero.

One recommended improvement in this prior art process has been to flash the high pressure liquid to a pressure intermediate between the evaporating and condensing pressures and return the vapor thereby produced to the appropriate intermediate stage of the compressor. This reduces the flash vapor in the reducing valve into the evaporator and also returns cold gas to cool the later stages of the compressor. The intermediate flash separator is called an "economizer" because it reduces the power consumption of the compressor slightly. Such a process requires that all the compressor work put into a stage be removed along with the refrigeration duty of the stage in the evaporator of the previous stage. At an efficiency of 80% in the compressor this requires that the compressor duty of each preceding stage by 1.25 times the theoretical duty and the first stage of a three stage operation will consume about twice the theoretical compressor work of the lowest temperature stage.

It has now been found that a significant improvement in cascade refrigeration systems is obtained by removal of the total pump work of all of the cycles in the cascade, including excess power lost in friction and irreversibility of the particular compression operation. The essential feature of this disclosure is the removal of the heat of compression of all cycles of a cascade refrigeration system directly to cooling water at ambient temperature. Only the latent heat of condensation is removed by the next higher temperature level in the cascade system of this invention, whereas in the conventional cascade system both the latent heat and the compressor work are removed at this level.

More specifically, the invention involves a cascade refrigeration system where low pressure vapor from an evaporator stage is compressed and then recycled for condensation to the evaporator of a previous stage by passing the low pressure vapor from an evaporator stage through a heat exchanger to heat said vapor to ambient temperature, compressing said heated vapor, removing the compressor work by passing said compressed vapor through a cooler, cooling said compressed vapor by passing said vapor through said heat exchanger in heat exchange relationship with said low pressure vapor, condensing said vapor in the evaporator of the next higher temperature cycle of the cascade system and recycling the liquid to the low pressure evaporator stage.

In order to further understand the invention, reference is now made to the drawings.

Figure 1:
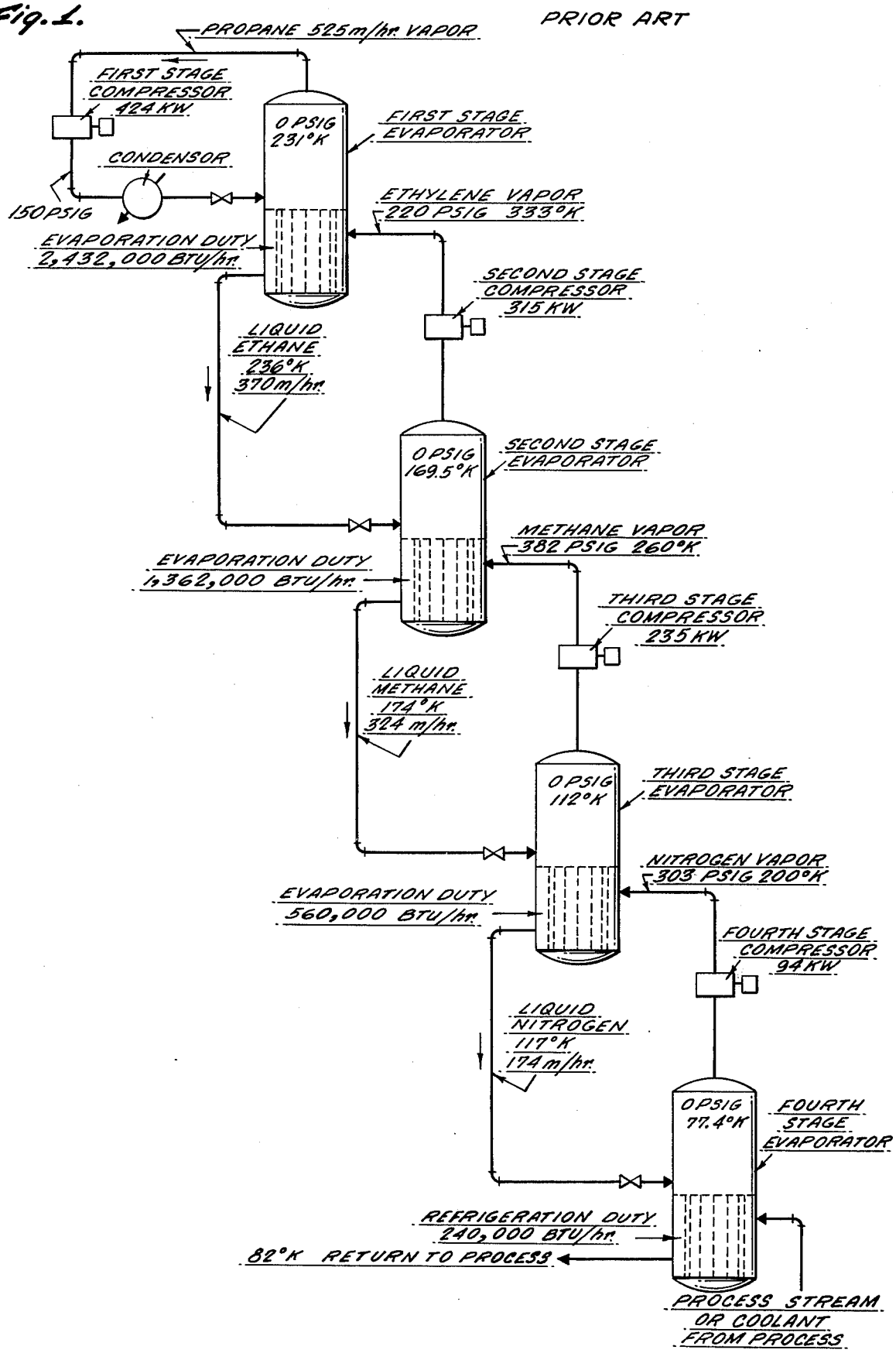
Fig. 1. PRIOR ART
FIG. 1 illustrates a conventional cascade refrigeration system of the prior art.

Referring now to FIG. 1, which is a conventional cascade refrigeration system, it is seen that in a typical system a flow of propane vapor at 525 moles/hr. is compressed in the first stage compressor to 150 psig. and this requires 424 kw of energy. The liquid propane then passes through a condenser to the first stage evaporator where the liquid is vaporized at 231° K. and 0 psig. (atmospheric pressure). This vaporization extracts 2,432,000 BTU/hr. from the compressed ethylene vapors (at 330° K and 220 psig), thereby condensing them to liquid at 236° K. The liquid ethylene passes at 370 moles/hr. to the second stage evaporator where evaporation occurs at 169.5° K. and atmospheric pressure, the ethylene vapors being compressed by the second stage compressor to 220 psig. at 333° K which requires 315 kw of energy. Methane vapors from the third stage compressor are condensed in the second stage evaporator due to the extraction of 1,362,000 BTU/hr. by the ethylene vaporization, and the liquid methane at 174° K. circulates at 324 moles/hr. to the third stage evaporator where vaporization occurs at 112° K. and atmospheric pressure, the methane then being compressed by the third stage compressor which requires 235 kw of energy. The fourth stage refrigerant is nitrogen, which after compression with 94 kw of energy in the fourth stage compressor, is passed as vapor to the third stage evaporator, where it is condensed by the heat absorbed by the vaporization of the methane (560,000 BTU/Hr). The liquid nitrogen then passes to the fourth stage evaporator at 117° K and 174 moles/hr. The fourth stage evaporator provides a refrigeration duty of 240,000 BTU/Hr. at about 82° K. which can be transferred directly to a process stream or supplied to the process through the use of a coolant.

In contrast to the above system, in the process of the invention the compressor work for each stage is removed directly to cooling water and increases progressively from one stage to the next. Heat duties transferred from one stage to the next increase only by the amount of liquid lost to vapor on flashing into the next stage. Some of this can be recovered by an intermediate flash similar to an economizer, in which the flash vapors are heated countercurrent to the high pressure liquid which is thereby cooled to reduce the subsequent flash.

In the basic process the low pressure vapor is heated by exchange against the recycle high pressure vapor to ambient temperature and then compressed. The compressor work is removed by cooling water and the high pressure gas is cooled in the exchanger before passing into the condensing chamber of the evaporator of the previous stage. In this way the incremental heat required in any given stage is equal only to the enthalpy difference between the high pressure gas entering the heat exchanger and low pessure gas leaving the heat exchanger at the hot end. In the case of a negative Joule-Thompson effect, this could even reduce the duty of the preceding stage, but even the case of a zero Joule-Thompson effect, the enthalpy difference will be equivalent to the few degrees of specific heat necessary to effect the heat transfer in the exchanger. This is negligible compared to the temperature rise resulting from the adiabatic compression of the gas and the additional heat input resulting from the inefficiency of the compressor.

The compressor efficiency at ambient temperature will be slightly less than at the lower temperatures of the conventional cascade refrigeration process, but the fact that the compressor work is all removed directly to cooling water results in a significant reduction in the heat duty of successive stages. In a four stage cascade, power requirements could be reduced as much as 60%.

Figure 2:
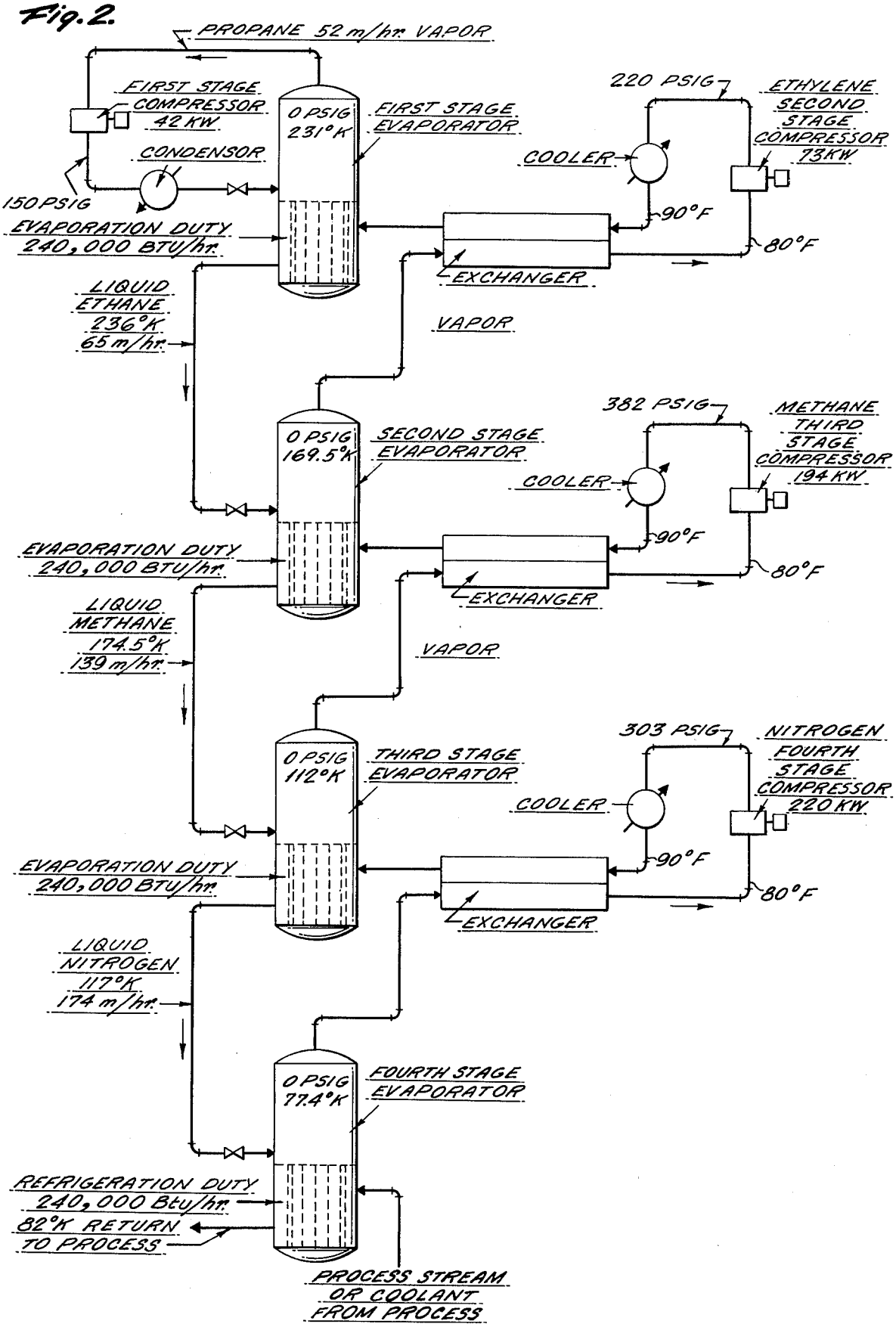
FIG. 2 illustrates the improved cascade system of the invention.

The process of the invention is further illustrated by the cascade refrigeration system shown in FIG. 2.

As can be seen from the flow sheet FIG. 2, propane vapor of 52 moles per hour from the first stage refrigerant is compressed in the first stage compressor to 150 psig. and this requires 42 kw of energy. After passing through a condenser the liquid propane is vaporized in the first stage evaporator at 231° K and atmospheric pressure. This vaporization extracts 240,000 BTU/hr. from the second stage ethylene vapors thereby condensing them to liquid at 236° K. The liquid ethylene passes at 65 moles/hr to the second stage evaporator where vaporization occurs at 169.5° K and atmospheric pressure. The ethylene vapors then pass through a heat exchanger at 80° F, hence to a second stage compressor to compress the vapor to 220 psig. and 73 kw of energy is required. The compressed ethylene passes through a cooler to remove the compressor work and then back through the heat exchanger at 90° F. The compressed vapor from the heat exchanger will be partially condensed and passes to the first stage evaporator for complete condensation and recirculation to the second stage evaporator.

In a similar manner, liquid methane from the second stage evaporator is passed at 174.5° K. at a rate of 130 moles/hr. to the third stage evaporator operated at 112° K and atmospheric pressure. The vaporized methane then passes through a heat exchanger at 80° F., is compressed by the third stage compressor to 382 psig., 194 kw of energy being required. The compressed methane vapors pass through a cooler and then through the heat exchanger to the second stage evaporator for condensation and recirculation. In the fourth stage evaporator liquid nitrogen is vaporized at 77.4° K and atmospheric pressure, the vapors passing through a heat exchanger and exiting at 80° F., after which they are compressed to 303 psig by the fourth stage compressor, 220 kw of energy being required. As in the previous stages, the compressed vapors pass through a cooler and then through the heat exchanger at 90° F. before entering the third stage evaporator for condensation and recirculation at 117° K and a flow rate of 174 moles/hr. Either the process stream or a coolant from the refrigeration process is passed through the fourth stage evaporator and provides the same refrigeration duty of 240,000 BTU/hr as the cascade system shown in FIG. 1.

The following table illustrates the significant difference in power requirements for the conventional and improved systems detailed above.

TABLE I

KW FOR 240,000 BTU/HR. REFRIGERATION at 77.5° K

| Cycle | Conventional Process | Process of the Invention |
|---|---|---|
| Nitrogen | 94 | 220 |
| Methane | 235 | 194 |
| Ethylene | 315 | 73 |
| Propane | 424 | 42 |
| | 1068 | 529 |

Thus, the process of the invention reduces the power requirements of a four stage cascade refrigeration system by 50%. In a five stage cascade system, the power requirements can be reduced to about 40% of the conventional process.

Figure 3:
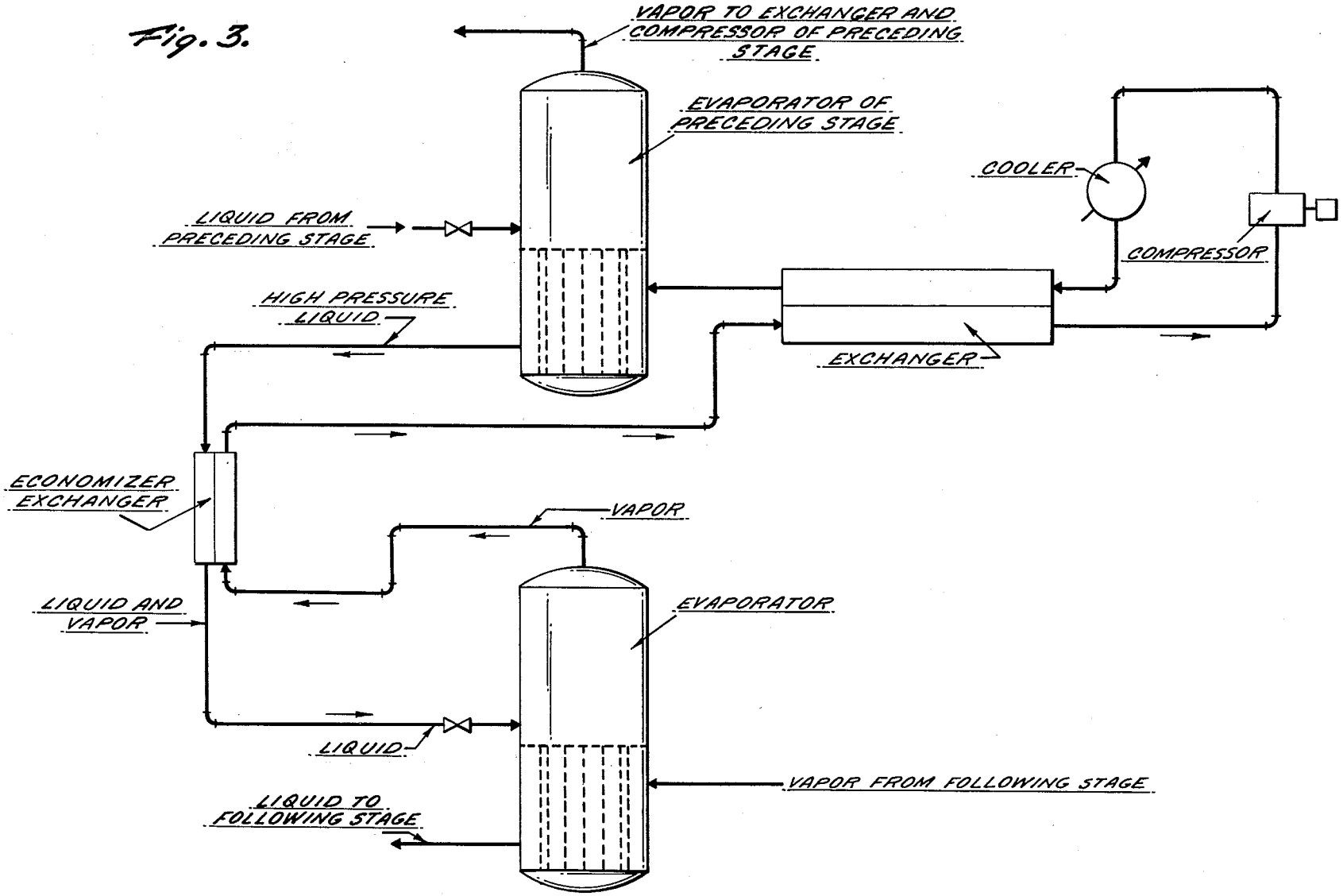
FIG. 3 illustrates a further embodiment of the invention using an economizer in the system.

In FIG. 3 a further embodiment of the invention is shown where an economizer exchanger is inserted between two evaporator stages. In a conventional cascade system these economizers are generally installed to flash the high pressure liquid to the intermediate pressure of the two stage compressor used on the vapor from the evaporator. The vapor from this flash passes countercurrent to the high pressure liquid to partially cool it and thereby reduce the flash vapor. The net result of such procedure is a reduction in the vapor to the first stage of the compressor and a small reduction in the total power required in the compression cycle. In this type of conventional system there is no advantage in passing all the vapor from the evaporator countercurrent to the high pressure liquid because the additional power required to compress a mole of gas at the resulting high temperature and volume will completely offset the reduction in the number of moles resulting from the cooling of the liquid.

In the present invention, however, the gases from all the stages are compressed at ambient temperatures and the quantity reduction resulting from the use of an economizer to exchange all the low pressure vapor against the high pressure liquid results in a corresponding reduction in the compression power requirement due to the decrease in the flash vapor in the evaporator. This modification is shown in FIG. 3 and it can be applied to every stage of the cascade. The greatest economy is realized in the nitrogen cycle where over 40% of the liquid is vaporized in flashing down to atmospheric pressure from 303 psig. This can be reduced to 20% by cooling the liquid with the low pressure vapor as shown and the power consumption in the nitrogen cycle shown in FIG. 2 will then be about 175 kw. Savings in the power requirements in the other three cycles will be smaller, but this modification can effect a further saving in the total power requirements of the cascade refrigeration system.

The invention claimed is:

1. A cascade refrigeration system where low pressure vapor from an evaporator stage is compressed and then recycled for condensation to the evaporator of a previous stage which comprises passing the low pressure vapor from an evaporator stage through a heat exchanger to heat said vapor to ambient temperature, compressing said vapor through a cooler, cooling said compressed vapor by passing said vapor through said heat exchanger in heat exchange relationship with said low pressure vapor, condensing said vapor in the evaporator of the next higher temperature cycle of the cascade system and recycling the liquid to the low pressure evaporator stage.

2. The refrigeration system of claim 1 having at least three stages where the refrigerant for the first stage is selected from the group of propane, ammonia, sulfur dioxide and a higher boiling chlorofluorocarbon refrigerant, the second stage refrigerant is selected from the group of ethane and lower boiling chlorofluorocarbon refrigerants, and the third stage refrigerant is methane or nitrogen.

3. A refrigeration system as in claim 2 containing at least four stages where the refrigerant for the fourth stage is methane or nitrogen.

4. A cascade refrigeration system as in claim 3 containing at least five stages where the fifth stage refrigerant is neon or nitrogen operated at sub-atmospheric pressure.

5. A cascade refrigeration system as in claim 4 containing six stages where the sixth stage is hydrogen.

6. A four stage cascade refrigeration system as in claim 1 where the first stage refrigerant is propane, the second stage refrigerant is ethylene, the third stage refrigerant is methane and the fourth stage refrigerant is nitrogen.

7. The cascade refrigeration system of claim 1 wherein the high pressure liquid taken from one stage is passed through an economizer countercurrent to the low pressure vapor of the same stage before said vapor is heated by countercurrent exchange against the high pressure gas.

* * * * *